United States Patent [19]

Peifer

[11] Patent Number: 4,712,311

[45] Date of Patent: Dec. 15, 1987

[54] GRAIN DRYING APPARATUS FOR STORAGE BIN

[76] Inventor: Ralph D. Peifer, R.R. 2, Box 155-A, Nokomis, Ill. 62075

[21] Appl. No.: 930,107

[22] Filed: Nov. 13, 1986

[51] Int. Cl.[4] ..... F26B 25/10

[52] U.S. Cl. ..... 34/56; 34/168; 34/172

[58] Field of Search ..... 34/56, 168, 171, 172, 34/167, 177

[56] References Cited

U.S. PATENT DOCUMENTS 2,148,946 2/1939 Hubmann et al. ..... 34/167

4,458,428 7/1984 Saeman ..... 34/167

*Primary Examiner*—Larry I. Schwartz

*Attorney, Agent, or Firm*—James N. Videbeck

[57] ABSTRACT

An apparatus for drying grain in a storage bin includes an elevated floor structure horizontally disposed across a storage bin. The floor includes a plurality of parallel ridges and valleys and is perforated to allow the passage of hot drying air upwardly through the floor and into any grain which is retained above the perforated floor. Each valley in the floor has holes therethrough for the passage of grain, and a plurality of cup-like grain containers are slidably positioned immediately below the valleys and are moveable horizontally from positions in communication with the valleys for receivcing grain therein to positions closed with respect to the elevated floor, but open with respect to a dry grain storage area below the elevated floor. Drive machinery is capable of continuously moving the grain containers over a range of speeds.

9 Claims, 7 Drawing Figures

FIG. 1
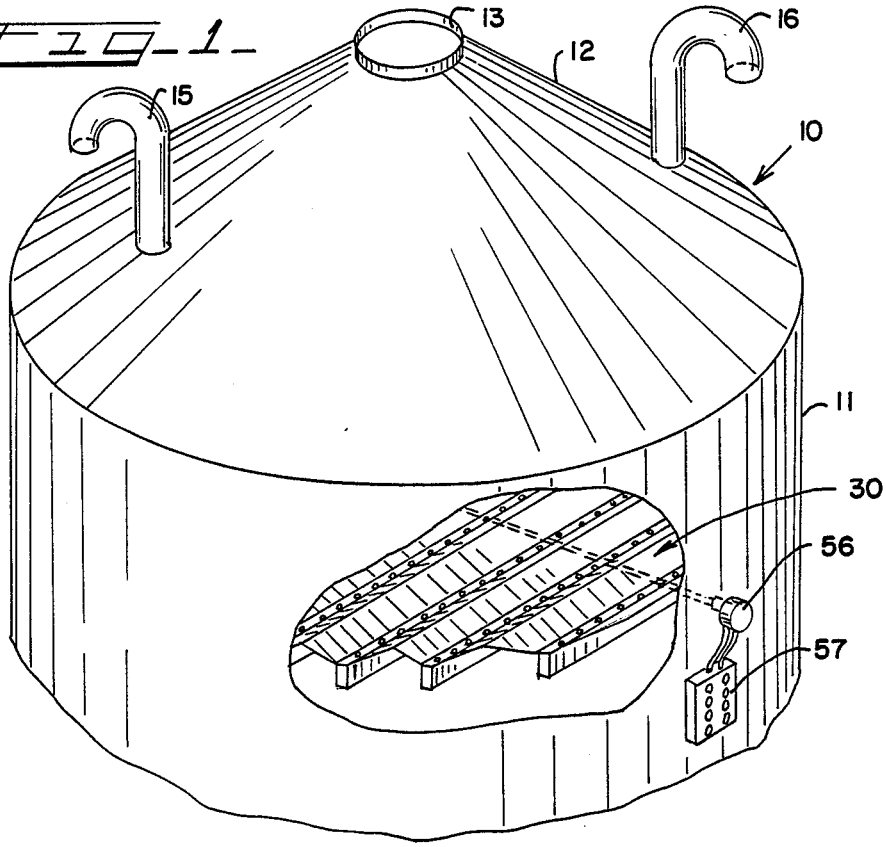
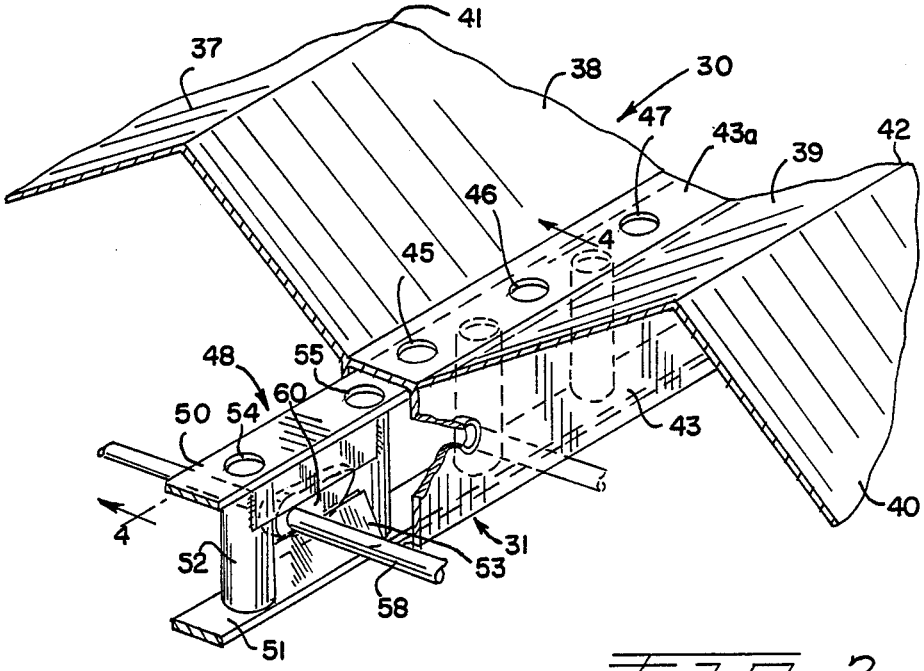
FIG. 2

GRAIN DRYING APPARATUS FOR STORAGE BIN

BACKGROUND OF THE INVENTION

This invention relates to improvements in grain drying apparatus for storage bins, and more particularly to an elevated floor system which dries grain at a position above the bottom of the storage bin, and provides for discreet movement of dry grain to the bottom of the storage bin where it may be stored or removed as needed without affecting the grain being dried above the elevated floor system.

Heretofore, grain drying systems have utilized hot air ducts providing a flow of drying air from the bottom of a grain drying bin. Such systems dry the grain near the bottom of the bin first, and thereafter push heated air through such dry grain prior to reaching the wet grain positioned on top of the dry grain. Continuous flow dryers move a limited amount of grain over areas through which hot air is passed. Passing such hot air over only one or two feet of wet grain has proven inefficient as the hot air is not completely saturated during its pass through the wet grain.

A need has arisen for an improved grain drying system which is adapted for use in conventional grain storage bins, which provides for efficient drying by substantially saturating hot air passing through the wet grain, allows any maintenance operations on the drying system to be conducted without moving grain from the storage bin, and allows dry grain to be removed from the storage bin without disturbing wet grain in the bin.

It is therefore an object of the present invention, generally stated, to provide an improved grain drying apparatus which is adapted for mounting and use in existing grain storage bins.

SUMMARY OF THE INVENTION

The invention is directed to an apparatus for drying grain in a grain storage bin of the type wherein grain is poured in the top of the bin. The apparatus comprises an elevated floor disposed substantially horizontally across the bin. The floor includes means for retaining grain above the floor while allowing heat from below the floor to pass vertically therethrough for drying such grain. At least a portion of the elevated floor is slanted between a high position and a low position for providing movement of grain above the floor toward the low position wherein a first opening is provided for passage of grain therethrough. A movable grain container is positioned below the first opening for receiving a predetermined amount of grain therein, and then is movable to a second opening in communication with the bottom of the grain container for passage of grain downwardly out of the container. The first opening and second opening are offset relative to each other to prevent both openings from being in simultaneous grain passing communication with the grain container.

BRIEF DESCRIPTION OF THE DRAWINGS

The features of the present invention, which are believed to be novel, are set forth with particularity in the appended claims. The invention may best be understood by reference to the following description of the currently preferred embodiment thereof taken in connection with the accompanying drawings in the several figures of which like reference numerals identify like elements, and in which:

FIG. 1 is a fragmentary perspective view of the top portion of a cylindrical storage bin with portions cut away showing the elevated grain drying structure constructed in accordance with the present invention;

FIG. 2 is an enlarged fragmentary perspective view of the elevated floor structure and grain containers shown generally in FIG. 1 with a cam drive mechanism and grain containers shifted, horizontally for exposed viewing;

DETAILED DESCRIPTION OF THE PREFERRED EMBODIMENTS

Figure 3:
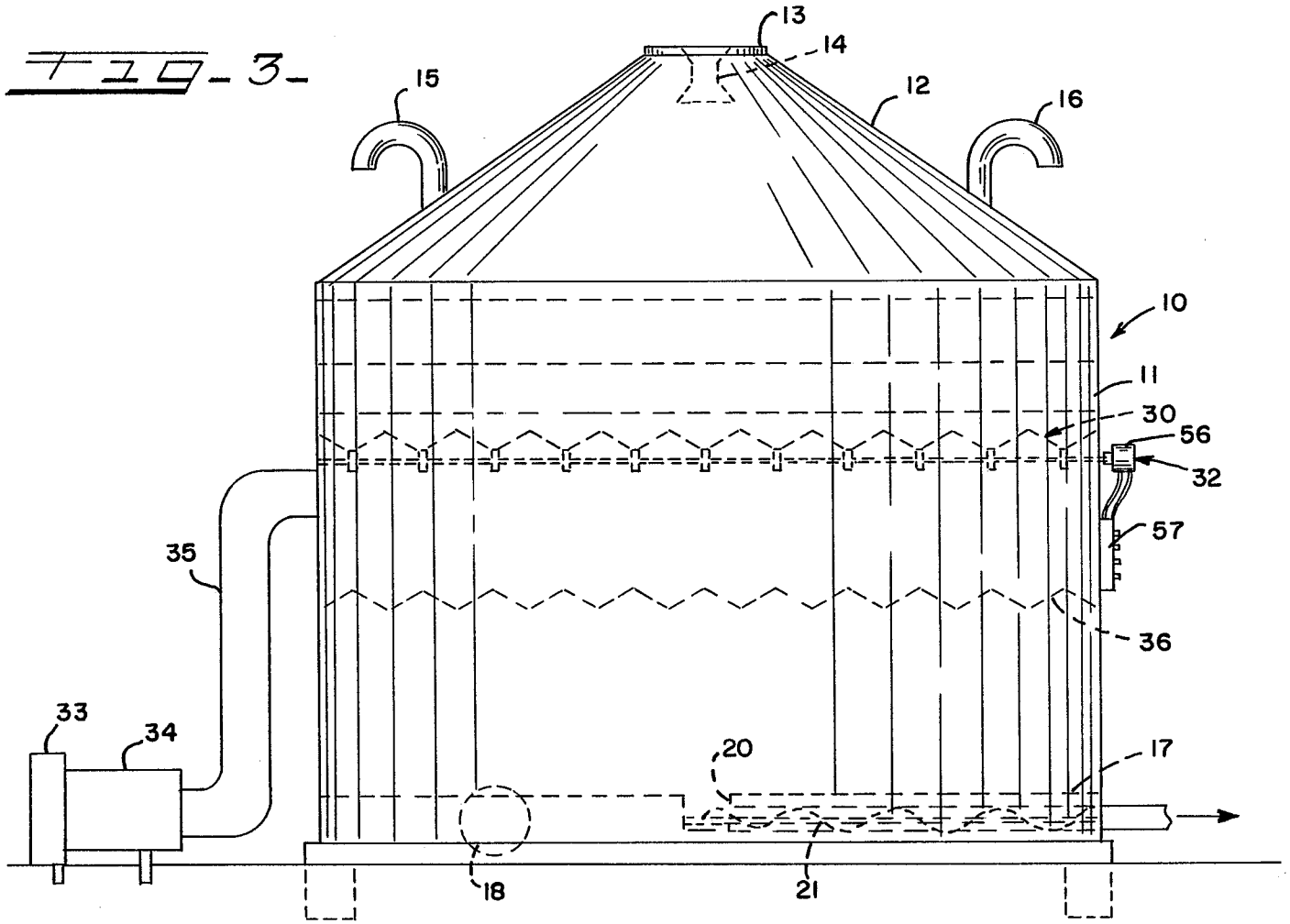
FIG. 3 is a side elevational view of the grain storage bin shown in FIG. 1 showing the relative positional placement of the improved grain drying system of the present invention therein.

Referring to FIGS. 1 and 3, a conventional grain storage bin 10 is constructed in this embodiment with a generally cylindrical vertical side wall 11, 33 feet in diameter and approximately 24 feet high for illustrative purposes, and includes a conical shape top 12 having a circular opening 13 at the center thereof allowing grain to be poured therein. Adjacent the top circular opening 13 is a grain spreader 14, and opposed air vents 15–16 are preferably positioned in diametrically opposed locations on the conical top for allowing the exhaust of saturated air. The bottom of the grain bin includes a perforated floor 17 having a centrifugal cooling fan 18 positioned therebelow for cooling dried grain stored above the bottom floor. At the center of the floor 17 is a grain feed aperture 20 in communication with an auger 21 through which stored grain exits the bin.

Referring to FIGS. 1, 2 and 3, the grain drying apparatus, constructed in accordance with the present invention, includes a corrugated-like, perforated, elevated floor 30 which extends substantially horizontally across the bin at a position in the preferred embodiment, approximately 7 feet below the apron of the conical bin top 12. Additionally, the grain drying apparatus includes a reciprocable dry grain transfer mechanism, generally indicated at 31, positioned immediately below the valleys in corrugated floor 30, and a cam drive mechanism 32 which powers the reciprocating grain transfer mechanism. Additionally, the grain drying apparatus includes a fan 33, a large air heater 34, duct work 35 to direct the heated air into the grain storage bin at a position above the dried grain level 36 in the bin and yet below the elevated floor 30.

Referring to FIGS. 1 and 2, the corrugated-like elevated floor structure, generally indicated at 30, is preferably made of 16 gauge galvanized steel with perforations approximating ⅛ inch through the sheet at predetermined intervals. In the preferred embodiment of the invention, the valleys in the corrugated-like floor are parallel and positioned on 36 inch centerlines. The perforated sheets, for example 37, 38, 39 and 40 in FIG. 2, are positioned to slope downwardly from peaks 41, 42 to a central valley 43*a* formed by the top wall 43*a* of a boxed support beam 43 with the top wall approximating 5 inches in width and running across the bin. The distance across the bin varies from a maximum diametrical length to a distance substantially smaller length depending on the perpendicular distance from the valley to the center of the bin. The support beams 43 may be secured to the bin side wall at its ends by conventional means, and the remainder of the bin side wall may be strengthened by various types of cross bracing to maintain the floor 30 in secured elevated position.

Referring to FIGS. 2 and 4–7, the top horizontal wall 43*a* of channel beam 43 constitutes the valley to which grain positioned on top of the perforated floor 30 will run by gravitation force, and includes a plurality of circular apertures therein, such as 45, 46 and 47 for illustrative purposes. In the preferred embodiment of the present invention utilizing a 33 foot storage bin 10, the apertures approximate 2 inches in diameter and are positioned on 8 inch centerlines along the length of top side 43*a* of channel beam 43. In one aspect of the present invention, a reciprocably slidable ladder-type structure, generally indicated at 48, is mounted inside the hollow interior of channel beam 43 and includes upper and lower flange members 50, 51, respectively, which are joined by a plurality of hollow tubular members 52, 53, for example, fixedly positioned therebetween. In the preferred embodiment, the tubular members have a hollow interior approximating 2 inches in diameter which is positioned in aligned communication with upper and lower apertures 54, 55, 56, and 57, respectively, in the upper and lower flanges 50, 51.

Similarly to apertures 45, 46 and 47 in upper side 43*a* of channel beam 43, a plurality of identically sized 45*a*, 46*a*, 47*a* also positioned on 8 inch center lines, are positioned in the bottom side 43*b* of channel 43 (FIGS. 4–7). However, the centerlines of those apertures 45*a*, 46*a*, and 47*a* are offset 4 inches from the centerlines of apertures 45, 46 and 47 in the opposing top wall 43*a* of channel beam 43, as shown most clearly in FIGS. 4–7. The size of the apertures, the spacing between the apertures and the offset between the upper and lower apertures, provides the tubular members 52, 53 with alternating openings to the upper side 43*a* of the channel beam 43, and then to the lower side 40 of the channel beam 43, as the ladder structure reciprocates in the channel beam 43.

The drive mechanism 32 for operating the grain transfer mechanism 31 includes a motor 56, in this embodiment hydraulically driven, and control panel 57. In the preferred embodiment, hydraulic motor 56 and panel 57 are positioned on the outer side wall 11 of storage bin 10, although other mounting arrangements may be made. Control panel 57 includes means for adjustably changing motor speed to provide for variable rate of movement of the dried grain from a position above the perforated floor 30 to a position therebelow. In order to prevent wear of the cam structure and the driven tubular members in the ladder structure 48, an oil bath or reservoir 60 is positioned on top of bottom flange 51 in the are between tubular members 52 and 53. During each rotation of the cam 60, it is bathed in the oil reservoir 61 to lessen frictional contact between the metal members. A dust shield 62 is positioned above the cam lobe and reservoir to keep grain dust from contacting the lubrication for the drive system. Access to the reservoir may be accomplished by a door (not shown) in the channel beam 43.

OPERATION

In operation, the grain drying structure of the present invention divides the grain storage bin 10 into two portions, an upper grain drying portion and a lower dry grain storage portion. In the present invention, the grain drying system is accessible for servicing or maintenance from beneath the elevated floor 30 so that grain does not have to be removed from the storage bin in order to provide any needed maintenance to the drying machinery.

Figure 4:
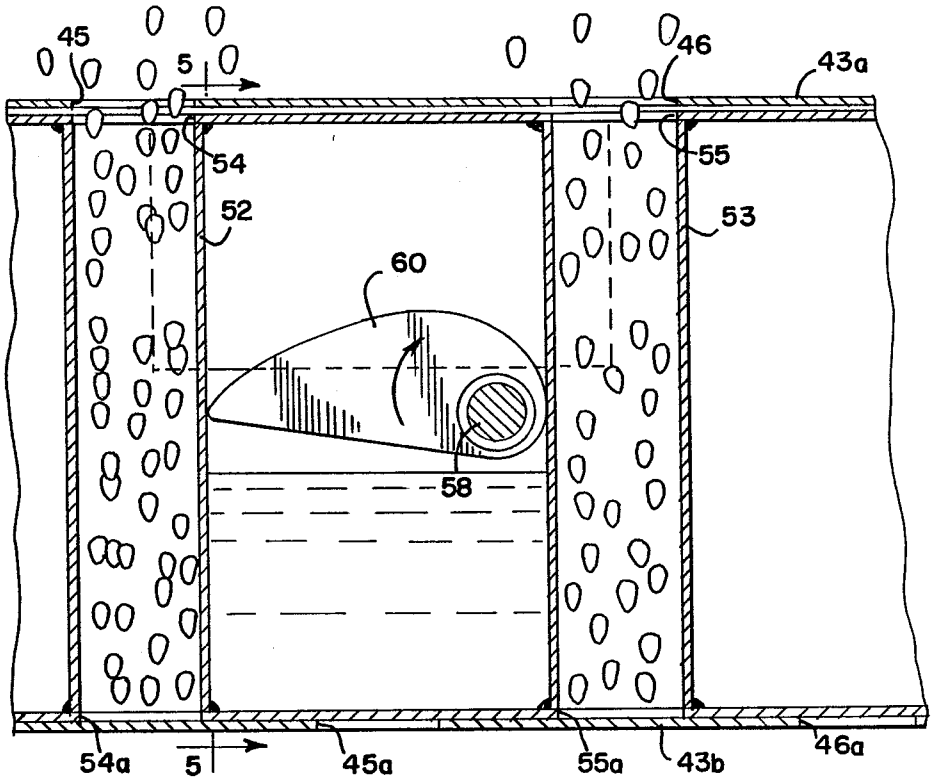
FIG. 4 is an enlarged fragmentary elevational sectional view of the movable grain containing apparatus and the rotatable cam movement structure as it would appear if taken along line 4—4 of FIG. 2.
Figure 5:
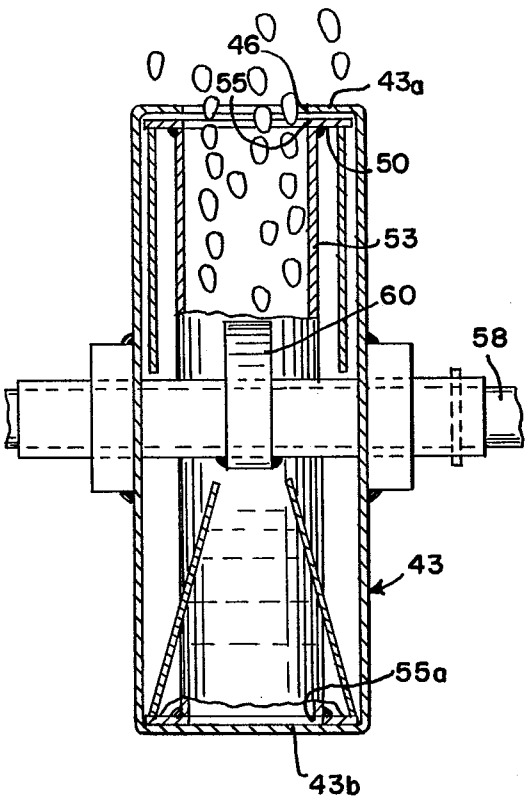
FIG. 5 is a cross-sectional view with portions cut away taken substantially along the line 5—5 of FIG. 4.
Figure 6:
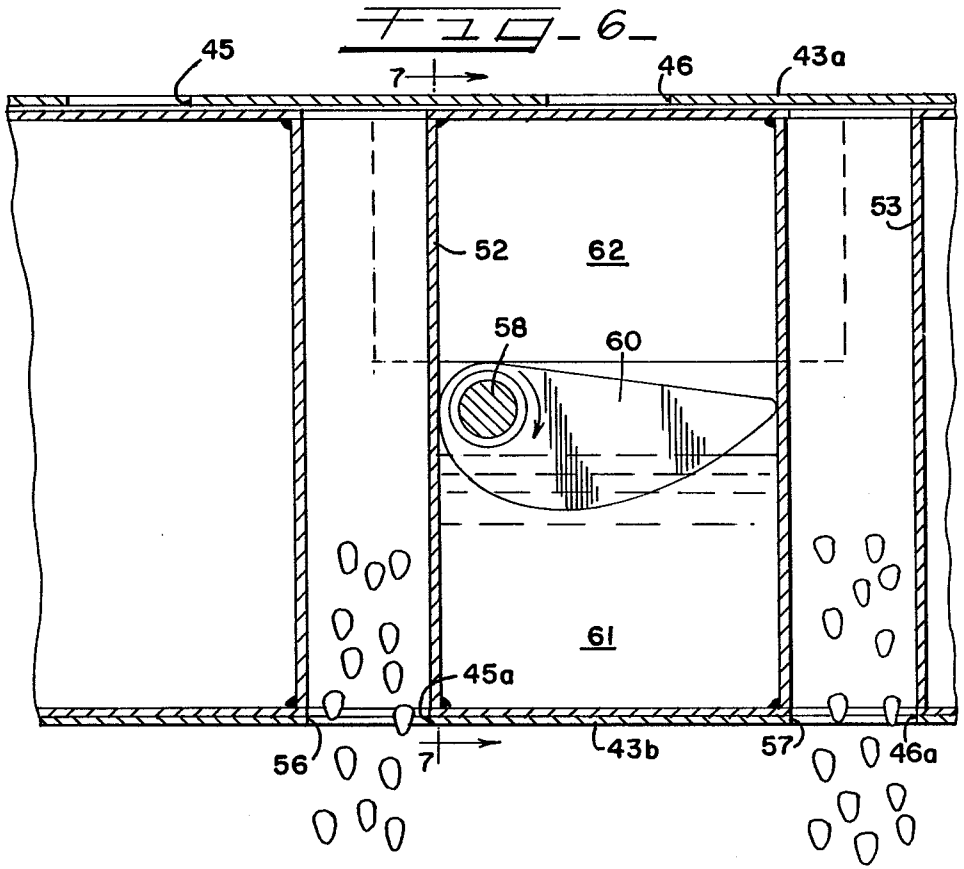
FIG. 6 is an enlarged fragmentary elevational sectional view similar to that shown in FIG. 4 wherein the container movement cam has moved the grain containers to a grain outflow position and including a lubrication reservoir and dust shield thereon.
Figure 7:
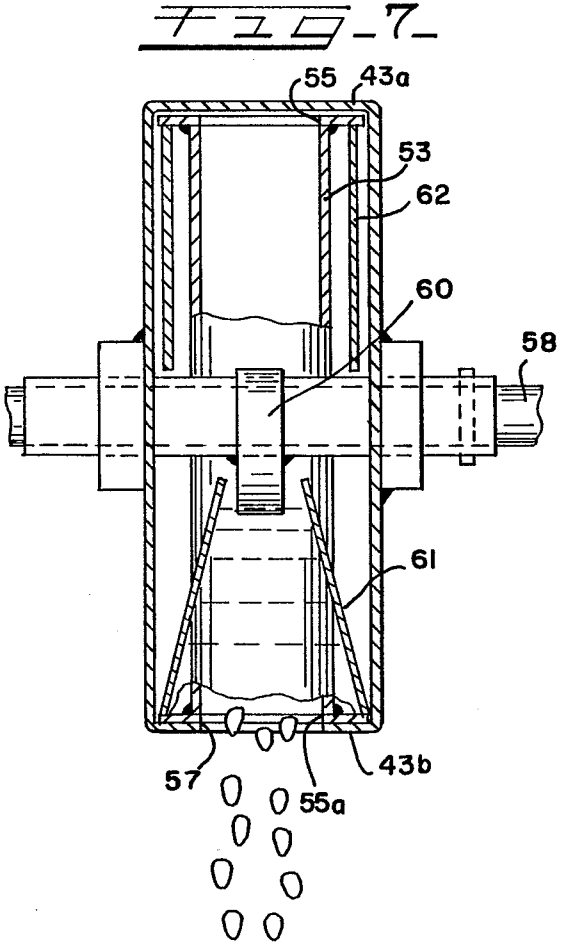
FIG. 7 is a cross-sectional view taken substantially along the line 7—7 of FIG. 6.

According to standard bin filling procedure, grain is poured into the circular opening 13 and is fairly evenly spread across elevated floor 30 by grain spreader 14. Grain positioned above elevated floor 13 is dried by hot air blown in by fan 33 through heater 34 and duct 35 into the open area below floor 30. The hot air rises through the perforations in floor 30 and, as it rises, absorbs moisture from the wet grain. Saturated air then may exit through top circular opening 13 or air vents 15, 16. In the drying process, the driest grain will be closest to the perforated floor 30. The slanted portions of perforated floor 30 direct the grain downward toward the valleys 43*a* and into apertures such as found at 45, 46 and 47. When the cam drive mechanism 32 is rotated such that the upper openings 54, 55 are in communication with apertures 45 and 46 as shown in FIG. 4, grain will fall into and fill the tubular members 52, 53. In the preferred embodiment, the 2 inch diameter tubular members are sized and positioned throughout the elevated floor 30 of the bin so that when all the tubular members in the bin are filled, it represents approximately 6.25 bushels of grain. After the tubular members 52, 53 are filled as shown in FIG. 4, the cam 60 rotates from the position shown in FIG. 4 to the position shown in FIG. 6 wherein the tubular mechanisms 52, 53 are aligned with bottom apertures 45*a*, 46*a* to allow the grain in the tubular members to fall and be substantially evenly distributed at the bottom of the grain storage bin 10. In FIG. 3, the line 36 shows the approximate distribution of the dried grain at the bottom of the bin 10.

The cam drive mechanism 32 includes adjustable motor speed means which will allow the mechanism to speed up or slow down and change the amount of grain per unit time which moves from the upper grain drying portion to the bottom dry grain storage portion of the bin 10. In the preferred embodiment, a normal speed of the grain drying mechanism approximates 33 revolutions per hour. While a preferred rotational speed is 33 revolutions per hour which approximates 200 bushels per hour transfered, the control mechanism 57 provides for speeds up to about 200 revolutions per hour and down to about one revolution per hour.

While the preferred embodiment of the present invention shows the improved grain drying apparatus mounted in a 33 foot diameter cylindrical bin, the grain drying apparatus is capable of being mounted in square, rectangular or virtually any shape grain storage bin. The system is simple, necessitating very little maintenance, and also allows any maintenance to be undertaken without removal of grain from the storage bin.

While one embodiment of the present invention has been shown and described, it will be understood by those skilled in the art that changes and modifications may be made without departing from the invention in its broader aspects. Therefore, the aim of the appended claims is to cover all such changes and modifications as fall within the true spirit and scope of the present invention.

What is claimed as new and desired to be secured under Letters Patent of the United States is:

1. An apparatus for drying grain in a grain storage bin of the type wherein grain is poured in the top of the bin, said apparatus comprising:

an elevated floor substantially horizontally disposed across said bin above and in spatial relation to a bottom of said bin, said floor including means for maintaining grain thereabove while allowing heat from below said floor to pass vertically therethrough for drying grain positioned thereabove;

at least a portion of said elevated floor being slanted between a high position thereon and a low position thereon, for moving grain above said floor to said low position, a first opening through said floor at said low position for passage of grain therethrough;

grain container means having a capacity to receive a pre-determined amount of grain therein, said container means being disposed subjacent said first opening;

a second opening in communication with a bottom of said grain container means for passage of grain therethrough; and said first opening and said second opening being disposed relative said grain container means to prevent both openings from being in communication with said grain container means simultaneously.

2. The apparatus as defined in claim 1 further including means for controlling the speed of a cycle including the opening and closing of said first opening and the opening and closing said second opening relative to said grain container means to control the flow rate of grain passing through said drying apparatus.

3. The apparatus as defined in claim 1 wherein said elevated floor is perforated for allowing heated air to rise therethrough while preventing grain from falling therethrough.

4. The apparatus as defined in claim 1 wherein said floor is constructed in corrugated form with said high position thereon being one of a plurality of ridges thereon and said low position being one of a plurality of valleys thereon.

5. An apparatus for drying grain in a grain storage bin of the type wherein grain is poured in the top of the bin, said apparatus comprising:

an elevated floor substantially horizontally disposed across said bin above and in spatial relation to a bottom of said bin, said floor including means for maintaining grain thereabove while allowing heat from below said floor to pass vertically therethrough for drying grain positioned thereabove;

at least a portion of said elevated floor being slanted between a high position thereon and a low position thereon, for moving grain above said floor to said low position, a first opening through said floor at said low position for passage of grain therethrough;

grain container means having a capacity to receive a pre-determined amount of grain therein, said container means being disposed subjacent said first opening;

a second opening in communication with a bottom of said grain container means for passage of grain therethrough;

said first opening and said second opening being disposed relative said grain container means to prevent both openings from being in communication with said grain container means simultaneously; and wherein said grain container means includes a tube-like structure closed on the sides and open at the top and bottom thereof, said tube-like structure being movable from a first position aligned with said first opening in said elevated floor to a second position aligned with said second opening.

6. The apparatus as defined in claim 5 further including drive means for moving said tube-like structure alternatively between said first and said second positions.

7. An apparatus for drying grain in a grain storage bin of the type wherein grain is poured in the top of the bin, said apparatus comprising:

an elevated floor substantially horizontally disposed across said bin above and in spatial relation to a bottom of said bin, said floor including means for maintaining grain thereabove while allowing heat from below said floor to pass vertically therethrough for drying grain positioned thereabove;

said elevated floor being constructed in corrugated form with at least a portion thereof being slanted between a high position thereon defining a plurality of ridges, and a low position thereon defining a plurality of valleys, for moving grain above said floor to said low position, a first opening through said floor at said low position for passage of grain therethrough;

grain container means having a capacity to receive a pre-determined amount of grain therein, said container means being disposed subjacent said first opening;

a second opening in communication with a bottom of said grain container means for passage of grain therethrough;

said first opening and said second opening being disposed relative said grain container means to prevent both openings from being in communication with said grain container means simultaneously; and said grain container means includes a plurality of tube-like structures, each closed on the sides thereof and open at the top and bottom thereof, certain of said tube-like structures being joined by a framework extending therebetween and movably positioned at said valleys.

8. The apparatus as defined in claim 7 further including drive means positioned between adjacent ones of said framework joined tube-like structures defined by a rotatable cam structure with opposed driving surfaces for alternatively reciprocably advancing one of said tube-like structures in one direction during one segment of its rotation and advancing an adjacent tube-like structure in an opposing direciton during a second segment of its rotation.

9. The apparatus as defined in claim 8 further including means for continuous lubrication of said cam structure as it drives said tube-like structure to decrease wear therebetween.

* * * * *